US006101746A

United States Patent [19]

Evans

[11] Patent Number: 6,101,746

[45] Date of Patent: Aug. 15, 2000

[54] FOOTWEAR

[76] Inventor: Anthony Evans, Sycamore House, Newland, Coleford, Gloucestershire GL16 8NJ, United Kingdom

[21] Appl. No.: 09/120,546

[22] Filed: Jul. 22, 1998

Related U.S. Application Data

[63] Continuation of application No. 08/700,391, Aug. 23, 1996, abandoned.

[51] Int. Cl.[7] ..... A43B 5/02; A43C 15/16

[52] U.S. Cl. ..... 36/128; 36/59 R; 36/59 C; 36/134

[58] Field of Search ..... 36/128, 59 R, 36/59 C, 134, 67 D, 67 R

[56] References Cited

U.S. PATENT DOCUMENTS

| | | | |
|---|---|---|---|
| Re. 26,419 | 7/1968 | McAuliffe | 36/128 |
| D. 272,772 | 2/1984 | Fohno . | |
| D. 292,443 | 10/1987 | Ihlenburg . | |
| D. 294,655 | 3/1988 | Heyes . | |
| D. 295,231 | 4/1988 | Heyes . | |
| 982,278 | 1/1911 | Kline | 36/59 R |
| 1,229,278 | 6/1917 | Johnson | 36/59 R |
| 1,989,475 | 1/1935 | Ehrmann | 36/59 R |
| 2,001,976 | 5/1935 | Riddell . | |
| 2,006,637 | 7/1935 | Goldenberg | 36/59 R |
| 2,261,785 | 11/1941 | Youmans | 36/59 R |
| 3,040,450 | 6/1962 | Phillips | 36/59 R |
| 3,127,687 | 4/1964 | Hollister . | |
| 3,354,561 | 11/1967 | Cameron . | |
| 3,581,414 | 6/1971 | Crawford | 36/59 R |
| 4,202,116 | 5/1980 | Dassler | 36/59 R |
| 4,347,674 | 9/1982 | George . | |
| 4,653,206 | 3/1987 | Tanel . | |
| 4,660,304 | 4/1987 | Tanel . | |
| 4,689,901 | 9/1987 | Ihlenburg . | |
| 4,723,365 | 2/1988 | Tanel . | |
| 4,748,750 | 6/1988 | George . | |
| 4,748,752 | 6/1988 | Tanel . | |
| 4,914,838 | 4/1990 | Ihlenburg . | |
| 5,203,097 | 4/1993 | Blair | 36/59 C |

FOREIGN PATENT DOCUMENTS

| | | |
|---|---|---|
| 0 273 919 | 7/1988 | European Pat. Off. . |
| 0 247 039 | 7/1990 | European Pat. Off. . |
| 0 491 805 | 7/1992 | European Pat. Off. . |
| 721701 | 6/1942 | Germany . |
| 8712790 | 12/1987 | Germany . |
| PCT/US90/05233 | 4/1990 | WIPO . |
| PCT/AU91/00056 | 2/1991 | WIPO . |

*Primary Examiner*—Ted Kavanaugh
*Attorney, Agent, or Firm*—Duane, Morris & Heckscher LLP

[57] ABSTRACT

A football boot has a plurality of studs disposed in a pattern which includes a part of at least one ring. The studs are asymmetric in that they provide grip along a first axis and permit sliding along another axis in a manner to encourage self cleaning. The studs are arranged with their respective first axes aligned along the locus of the ring and their respective second axes aligned transversely of the ring.

15 Claims, 5 Drawing Sheets

FOOTWEAR

RELATED APPLICATIONS

This application is a continuation of U.S. patent application Ser. No. 08/700,391, filed on Aug. 23, 1996, entitled "FOOTWEAR" now abandoned.

This invention relates to an article of studded footwear for use in sport or in another activity wherein an enhanced grip is required for use on a natural or artificial penetrable surface such as grass, clay, particulate all-weather surfaces, Tartan (Registered Trade Mark) track surfaces, artificial turf such as "Astroturf" (Registered Trade Mark) and all comparable natural and artificial surfaces. Hereinafter the term "boot" will be used to denote each and any article of footwear.

Conventional studded boots, such as football boots, each have a sole from which project a number of fixed or removable studs. The studs have been in the form of vertical (or steep) sided cylindrical, conical or frustro-conical bodies, or bodies which are made up of cylindrical and frustro-conical parts. Known studded boots have had several disadvantages. Firstly, the number of studs has been limited, because the provision of a relatively large number of relatively closely-spaced studs simply encourages the build-up of a pad of surface material (such as mud and grass) between the studs, forming a platform which negates the effect of the studs. Limitation of the number of studs to as few as four or six on the sole of a boot eliminates this problem, but causes such a boot to be uncomfortable and/or unstable on hard surfaces with an attendant danger of discomfort or injury due to tripping or falling, or due to excessive pressure being applied to small parts of a wearer's foot.

Additionally, such studs have to be large enough to grip firmly in wet/muddy conditions and thus are often so long as to give an excessive grip in drier conditions which may occur at different times, or in different parts of a playing surface. Such excessive grip can cause a wearer's boot to "lock" to a surface when a sudden turn is made or occurs and there is a possibility of injury from this circumstance.

It is an object of the present invention to provide a studded boot ("boot" meaning any article of footwear) wherein the above disadvantages are obviated or minimised.

The present invention provides a boot having a plurality of studs depending from its base, each stud being in the form of a body having, when viewed in underneath plan, a first axis and a second axis transverse to the first axis, the body providing at each end of the first axis a ramp surface which leads from a surface of the boot base to a crown surface of the stud body, and the body having at at least one end of the second axis a barrier surface, so that when the stud penetrates a penetrable surface, a force tending to cause movement of the stud along the second axis in at least one direction is resisted and said stud grips the surface, and a force tending to cause movement of the stud along the first axis is not substantially resisted, the stud performing movement relative to the surface tending to wipe any accumulated surface material from its surfaces at the ends of the second axis.

The invention further provides a boot having a plurality of studs depending from its base, and disposed in a pattern which includes a part of a least one ring on an area of the boot base, each stud being asymmetric in that it provides grip along a first axis and permits sliding along a second, transverse, axis in a manner to encourage self-cleaning, the studs being arranged with their respective first axes aligned along the locus of the ring and with their respective second axes extending transversely of the ring.

The ring can be circular or non-circular.

Each stud can be longer along its first axis than along its second axis.

The invention additionally provides a boot having a sole part and a heel part, at least one of the sole and heel being provided with a plurality of studs each having a barrier surface, the studs being arranged around a position generally central of the relevant sole or heel part and each having its barrier surface facing towards said position.

The studs can be arranged in one or more partial or complete rings, circular, or of any other shape.

At least one and preferably each stud can have a barrier surface at one or each end of its second axis. The barrier surfaces can be a flat planar surface or can be slightly concave or convex. The, or each, barrier surface of each stud can merge with its end ramp surfaces by smooth transition or at sharp edges. The crown surface of each said stud can be a flat planar surface or can be a smooth, dome like surface and can merge smoothly or sharply with the ramp and barrier surfaces. The first axis of the stud can be a straight line or can be a curved line such as a fraction of a circle.

In an array of studs of which each has only one barrier surface at one end of its second axis, the barrier surface preferably faces the inside of the ring.

Each ramp surface can, when the stud is viewed along the second axis, have a convex profile adjacent the base surface and a concave profile between the convex profile and the stud crown surface.

The studs can be integral with the boot base, for example by being moulded therewith, or can be attached to the base by a screw-in or plug-and-socket arrangement.

A respective array of studs can be provided on a heel and sole portion of the boot base.

The invention will be described further, by way of example, with reference to the accompanying drawings, wherein.

Figure 24A:
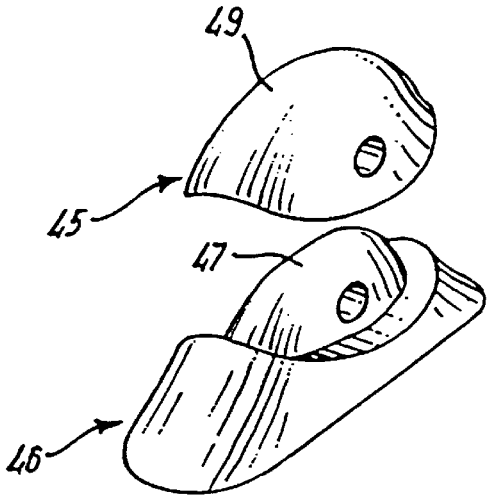
Figure 24B:
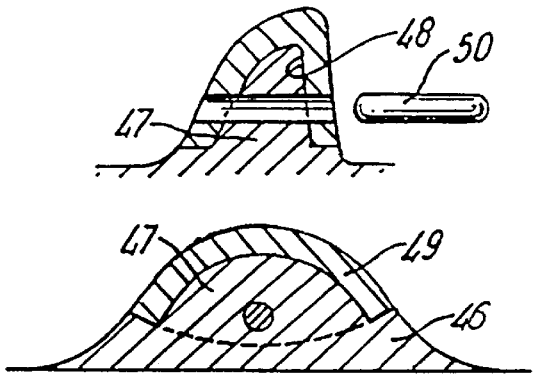
Figure 25:
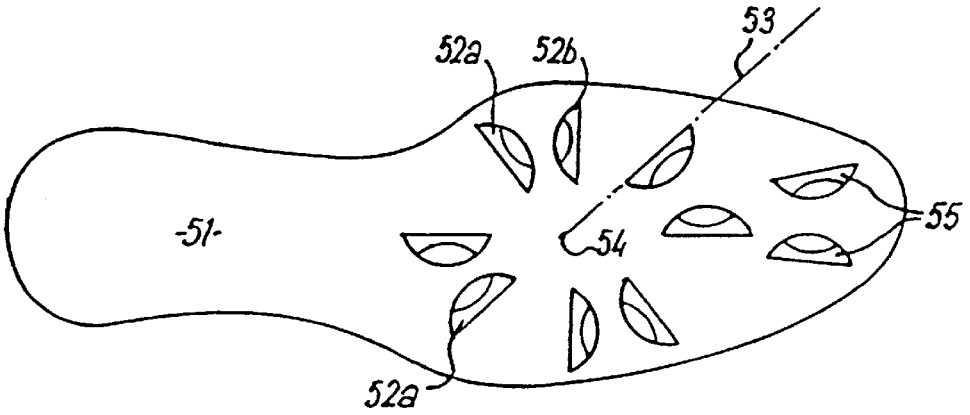

FIGS. 23*a* to 23*d* are sketches illustrating possible ring arrays of studs on the bases of boots of the invention;

FIG. 24*a* is a perspective view of a variation;

FIG. 24*b* is a vertical cross-sectional view showing the variation of FIG. 24*a*; and said FIG. 25 is an underneath plan view of a further embodiment.

Figure 4:
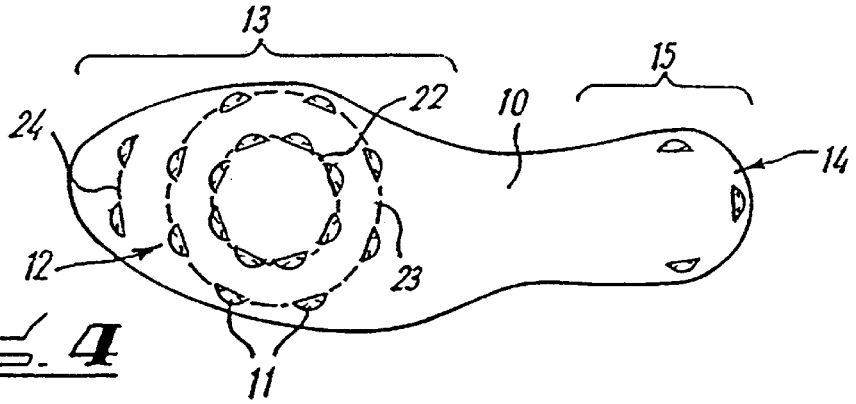
FIG. 4 is an underneath plan view of a preferred embodiment of the boot of the invention.

Referring to the drawings, FIG. 4 is an underneath plan view showing the base 10 of a preferred boot of the invention having a plurality of studs 11 arranged in a first array 12 on a sole 13 of the base 10 and a second array 14 on a heel 15 of the base 10.

In this and ensuing embodiments the studs 11 are shown as being integrally formed with the base 10 as by moulding or comparable forming processes. However, it is possible that the studs 11 could be individually attachable to the base by fasteners or by a screw or plug-and-socket arrangement. This feature is not germane to the invention and is therefore not described in detail.

Figure 1:
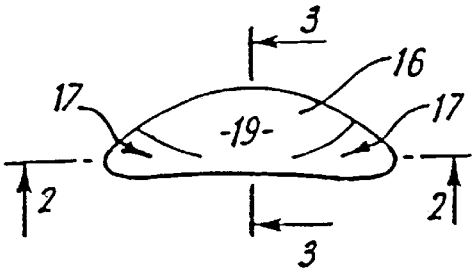
FIG. 1 is an underneath plan view of a stud of a first preferred embodiment of the boot of the invention.
Figure 2:
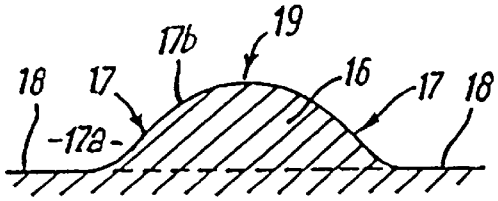
FIG. 2 is a cross-sectional view on line 2—2.
Figure 3:
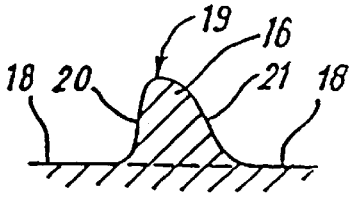
FIG. 3 is a cross-sectional view on line 3—3.

Referring to FIGS. 1 to 3 it will be seen that each stud 11 is in the form of a solid body 16 having a first axis 2—2 and a second axis 3—3. The second axis 3—3 can be at right angles to axis 2—2 but does not have to be so. Considered in cross-section along axis 2—2 the body 16 has at each end of the axis 2—2 a ramp surface 17 leading from the base surface 18 to a crown surface 19 of the stud 11. The ramp surface 17 is divided into a concave part 17*a* adjacent surface 18 and a convex part 17*b* adjacent the crown surface 19. The stud 11 is longer along the first axis 2—2 than it is along second axis 3—3. Viewed in cross-section on axis 3—3 (FIG. 3) it will be seen that the stud body 16 provides a steep barrier surface 20 on one side and a less-steep barrier surface 21 on its other side. Barrier surface 20 can be flat in inverted plan view, slightly concave as shown, or slightly convex. Barrier surface 21 will normally be convexly curved.

The ratio of the length of the stud 17 along axis 2—2 to the width along axis 3—3 (at comparable levels below surface 18) is illustrated in FIGS. 1 to 3 as being about 3:1. This ratio can vary from 1:1 to 10:1, but a range from 2:1 to 5:1 is preferred and gives a best balance between the conflicting needs of gripping power and intrinsic strength. The ratio of the "height" of the stud 11, i.e. the vertical distance from surface 18 to the lowermost crown surface 19 of the stud 11, to the width of the stud at the level of surface 18 is illustrated as being about 1:1.3. However, variations from 1:0.7 up to 1:3 are possible. A preferred range is from 1:1 to 1:2.

It will be appreciated that the stud 11 presents a "streamlined" shape in each direction along axis 2—2 and upon being urged to travel along axis 2—2 whilst penetrating a surface will tend to slide easily through the surface creating a groove or channel therein. Contact between the faces of the stud during such travel will tend to wipe surface material from the stud during such travel, particularly surface material (such as mud or grass) which tends to accumulate adjacent barrier surfaces 20 and 21. These surfaces are thus kept clear of obstruction. When a force is applied to the stud 11 in a direction along the axis 3—3, the steep barrier surfaces 20, 21 act to cause the stud 11 to grip a surface firmly and militate against the wearer slipping.

FIG. 4 shows how the plurality of studs 11 are arranged in the two arrays 12 and 14, one on the sole and the second on the heel of the boot 10. The heel array 14 is of lesser importance as heel pivoting is relatively rare, and seldom causes injury. However, the previously-discussed problem of "locking" of the boot to a surface possibly causing an ankle injury is particularly relevant to the sole portion. FIG. 4 shows how an array of studs on the sole is arranged in rings 22, 23, 24 (each as hereinbefore defined) surrounding a central area of the sole. Axes 2—2 of the studs 11 are aligned along the rings 22, 23, 24 with steeper surfaces 20 on the inside. Here, circular rings are shown but oval, elliptical or other shaped rings are possible. Ring 22 is complete, ring 23 is substantially complete, but ring 24 is only partial. The effect of the disposition of the studs in array 12 is to provide an improved tendency to allow the boot to pivot about a central part of the sole, whilst not impairing resistance to linear movement of the sole relative to a surface.

Figure 5:
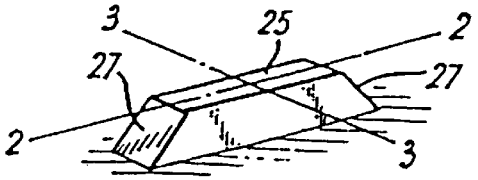
FIG. 5 is a perspective view of a second shape of stud.
Figure 6:
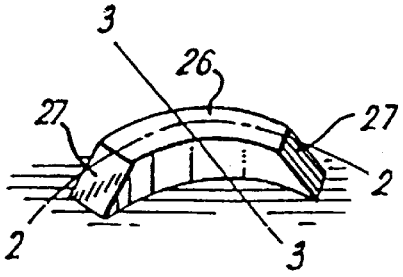
FIG. 6 is a perspective view of a third shape of the stud.
Figure 7:
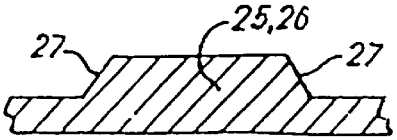
FIG. 7 is a cross-sectional view on line 2—2 of FIG. 5 or 6.
Figure 8:
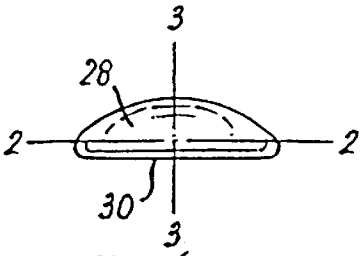
FIG. 8 is a plan view of a fourth shape of stud.
Figure 9:
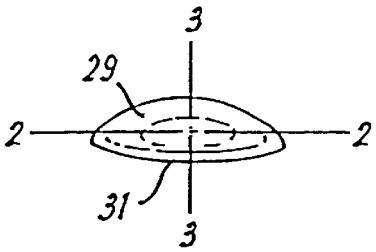
FIG. 9 is a plan view of a fifth shape of stud.
Figure 11:
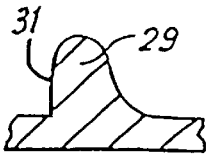
FIG. 11 is a cross-sectional view on line 3—3 of FIG. 9.

FIGS. 5, 6 and 7 illustrate a second and third possible shape of stud 25, 26. Stud 25 is of rectangular block or blade like form having planar ramp surfaces 27 at its ends. Longer axis 2—2 is straight. Stud 26 (FIG. 6) is comparable to stud 25 but has a curved axis 2—2.

Figure 10:
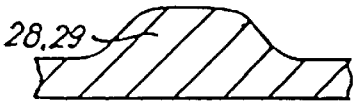
FIG. 10 is a cross-sectional view on line 2—2 of FIG. 8 or 9.
Figure 12:
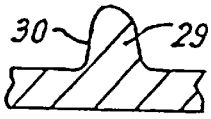
FIG. 12 is a cross-sectional view on line 3—3 of FIG. 8.

FIGS. 8 to 12 illustrate fourth and fifth studs 28 and 29, differing from stud 11 mainly in that their inner barrier surfaces 30, 31 are planar and can slightly convex respectively. Stud 28 is symmetrical along axis 3—3 as seen in FIG. 12. Both have profiles on axis 2—2 as shown in FIG. 10.

Figure 13:
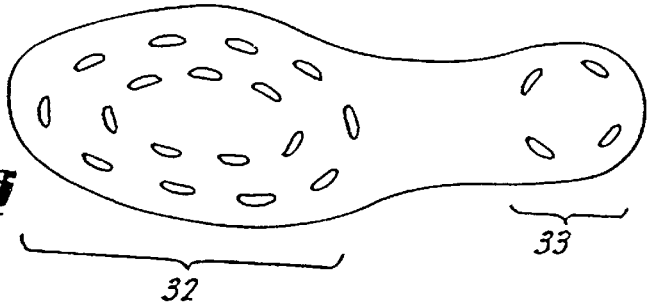
FIG. 13 is an underneath plan view of a second preferred boot having studs in a different array.

FIG. 13 is comparable to FIG. 4 but shows modified arrays 32, 33 of studs on sole and heel.

Figure 14:
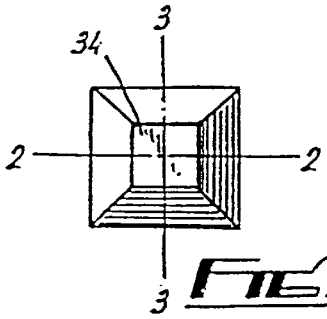
FIG. 14 is a perspective view of a sixth shape of stud.
Figure 15:
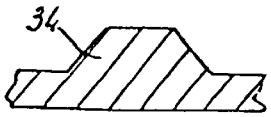
FIG. 15 is a cross-section on line 2—2 or 3—3 of FIG. 14.

FIGS. 14 and 15 show a sixth stud 34 which is symmetrical along axes 2—2 and 3—3. When used in the preferred ring arrays of FIGS. 4 and 13 such a stud may achieve gripping and self-cleaning properties comparable to the other studs described herein. However, without arrangement in such an array it is doubtful whether this stud can achieve these desired properties.

Figure 16:
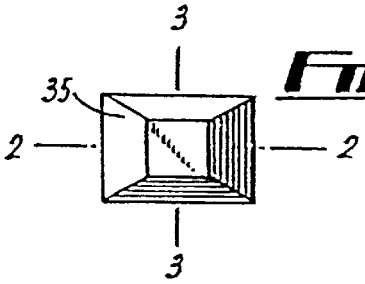
FIG. 16 is a perspective view of a seventh shape of stud.
Figure 18:
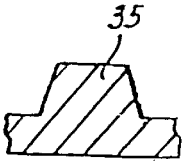
FIG. 18 is a cross-section on line 3—3 of FIG. 16.
Figure 17:
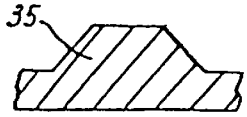
FIG. 17 is a cross-section on line 2—2 of FIG. 16.

FIGS. 16 to 18 show a seventh stud 35 whose shape is comparable to that of FIG. 5, the ratio of length to breadth being smaller.

Figure 19:
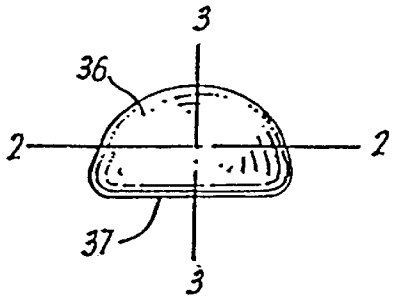
FIG. 19 is a perspective view of an eighth shape of stud.
Figure 20:
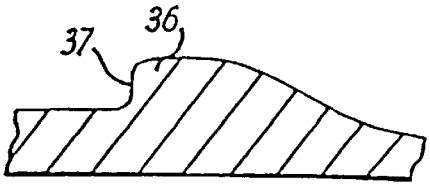
FIG. 20 is a cross-section on line 3—3 of FIG. 19.
Figure 20A:
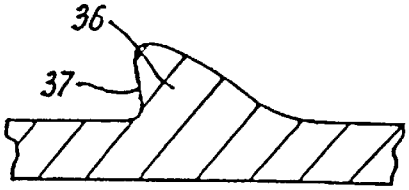

FIGS. 19, 20, 20*a* show a stud 36 whose general shape is comparable to that of FIGS. 1 to 3, but whose ratio of length along 2—2 to width along 3—3 is about 1.5:1, and there is only one barrier surface 37. This stud 36 is effective to grip only when moved in one direction along 3—3.

Figure 21:
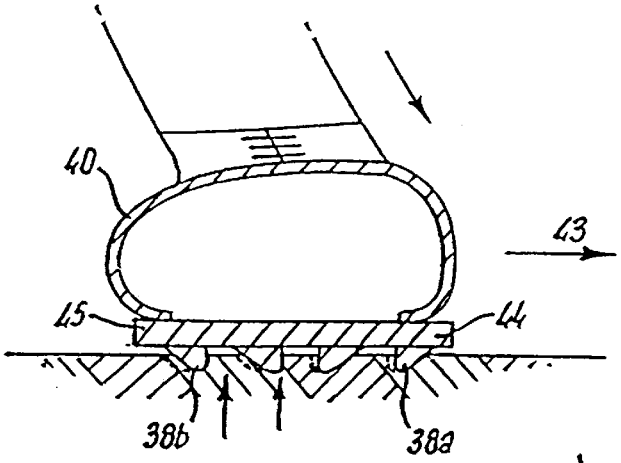
FIGS. 21 and 22 are vertical cross-sectional views illustrating boots of the invention in use.
Figure 22:
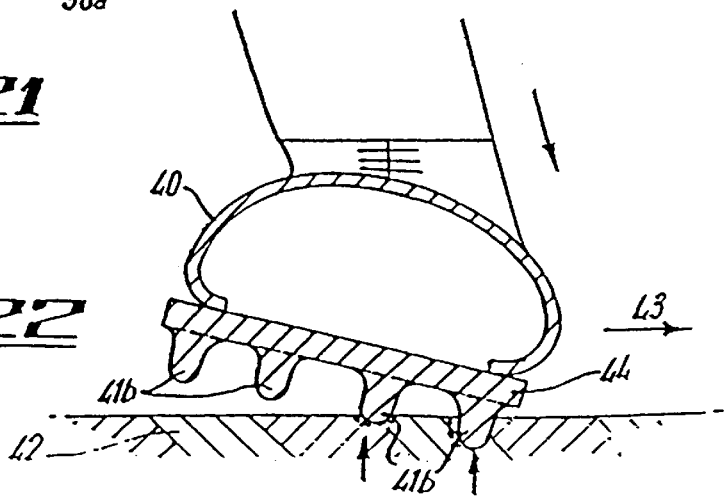
Figure 23A:
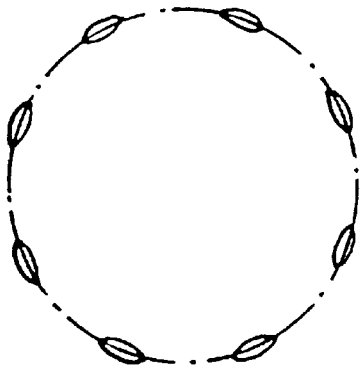
Figure 23B:
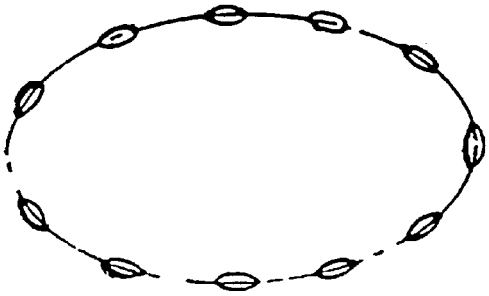
Figure 23C:
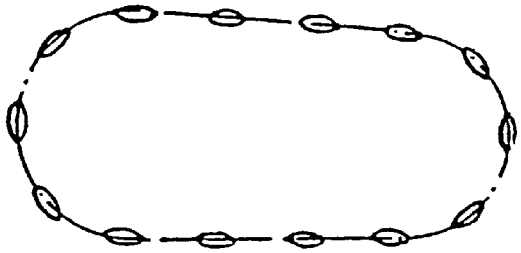
Figure 23D:
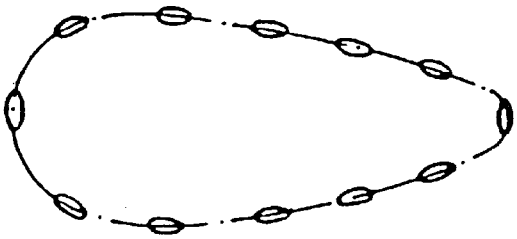

FIGS. 21 and 22 are sketches which illustrate an additional advantage of the array dispositions of the studs of this invention when the studs 38 are distinctly asymmetric an axis 3—3 (for example the studs of FIGS. 1 to 3 and of FIGS. 19 to 20*a*). The barrier surfaces 39 in these cases are on the inside of the rings. Referring to FIG. 22, a conventional boot 40 with steep sided studs 41 is shown in the act of being brought into contact with a surface 42 with a component of motion in the direction of arrow 43. In this circumstance upstream studs 41*a* may make first contact with and dig into the surface 42 and grip first, causing the boot to tilt about its upstream edge 44, leading to instability and possible injury. In FIG. 21, if first contact occurs at studs 38*a* they do not grip, but tend to slide until downstream studs 38*b* come into engagement and grip with leading surfaces 38*b*. This means that the grip or braking force is applied to the sole near at its downstream edge 45, thus reducing the tendency for it to tilt. Grip is assured, but a sudden grip and tilt is avoided.

The invention is not limited to the precise details of the foregoing and variations can be made thereto. For example, a boot of the invention may have some but not all of its studs of shape corresponding to those described and illustrated. For example, studs on the boot sole may be in accordance with the invention, whereas heel studs may be of conventional form. Many other variations are possible.

By means of the invention herein disclosed, it is possible to provide an article of sports footwear wherein the stud formation and configuration will provide grip in any direction of linear thrust whilst permitting rotation. The density of stud distribution and the stud size many be varied according to the sport and the playing surface and conditions involved, whilst the number of studs provided in any instance may be in excess of the number of conventional studs which could be used in like circumstances due to the self-cleaning characteristics of the stud of the invention.

Furthermore, the stud of the present invention will allow of the use of a lighter, and more flexible sole material in the construction of this article of footwear finally, a possible variation of the profile of the ramp surface will provide for a corresponding variation in the resistance to rotation of the article in use.

FIGS. 24*a* and 24*b* illustrate a construction wherein the size of the stud 45 can be varied by replacement of an upper part thereof to suit different playing surfaces and/or conditions and/or sports. This variation of stud 45 has a base 46 integral with or secured to a shoe (not shown). Base 46 has a central upstanding core 47 which can be accommodated with a recess 48 in a crown 49 whose shape is complementary to that of base 46 and forms therewith a stud of shape comparable to that in any of the earlier embodiments. A pin 50 of plastics or like material passes through aligned holes in the crown 49 and core 47 to retain the crown 49. The pin 50 can be an interference fit in the holes.

A small plier-like tool (not shown) can be used to insert and remove the pins when a stud needs to be removed or replaced. Studs can be replaced because of wear, or for replacement by higher or lower studs to suit different ground conditions.

FIG. 25 is an underneath plan view of a further variation. Here, a sole 51 is provided, on its forward portion, with a plurality of studs constructed in accordance with the foregoing. However, the studs 52 are arranged so that their longitudinal axes extend generally along radi 23 from a centre 54. This produces a shoe wherein pivoting of a shoe about the ball of the foot is greatly discouraged, Such a construction can be very useful in relation to the left shoe for a right handed golfer or the right shoe for a left handed golfer. To reduce any directionality in pivoting the studs can be arranged so that alternate ones 52*a*, 52*b* have their more vertical faces directed in opposite directions about the centre. If desired a pair of opposed further studs 54 can be arranged on a toe portion of the shoe.

Many other variations are possible within the scope of the invention.

What is claimed is:

1. A boot having a plurality of studs for penetrating a penetrable surface, said studs depending from the base of the boot, the studs being in the form of an arcuate body having, when viewed in underneath plan, a first axis and a second axis transverse to the first axis, the body providing at each end of the first axis a ramp surface which leads in an inclined manner substantially from a surface of the boot base substantially to a crown surface of the stud body and the body having a concave barrier surface provided at one of the ends of the second axis, the stud being asymmetric about the first axis in the plane of the second axis, so that when the stud penetrates a penetrable surface, a force tending to cause movement of the stud along the second axis in one direction is resisted and said stud grips the surface, and a force tending to cause movement of the stud along the first axis is not substantially resisted, the stud performing movement relative to the surface tending to wipe any accumulated surface material from its surfaces at the ends of the second axis and wherein at least some of the studs are disposed in a pattern which includes one or more partial or complete rings, the studs being arranged such that the barrier surface of the stud is located at the inside of the ring and the outer stud surface, that is, the surface located at the outside of the ring, is, at least in part, convex, characterized in that the barrier surface of the stud is more steep than the outer stud surface, and wherein said ramp surface has a convex portion adjacent to said crown surface.

2. A boot as claimed in claim 1, wherein the stud is longer along its first axis than its second axis.

3. A boot as claimed in claim 1, wherein the barrier surface is a flat planar surface.

4. A boot as claimed in claim 1, wherein said ramp surface, when viewed along the first axis, also has a concave part adjacent to the base surface, the convex part being between the concave part and the stud crown surface.

5. A boot as claimed in claim 1, wherein at least some of the studs are integral with the boot.

6. A boot as claimed in claim 1, wherein at least one of the studs does not have a flat crown surface.

7. A boot as claimed in claim 1, wherein the ratio of the length of the stud along the first axis to the length of the stud along the second axis is in the range from 1:1 to 10:1.

8. A boot as claimed in claim 1, wherein the ratio of the length of the stud along the first axis to the length of the stud along the second axis is in the range from 2:1 to 5:1.

9. A boot as claimed in claim 1, wherein the ratio of the length of the stud from the sole to the crown surface of the stud to the width of the stud is in the range from 1:0.7 to 1:3.

10. A boot as claimed in claim 1, wherein the ratio of the length of the stud from the sole to the crown surface of the stud to the width of the stud is in the range from 1:1 to 1:2.

11. A boot as claimed in claim 1, wherein the outer stud surface is wholly convex.

12. A boot as claimed in claim 1, wherein the outer stud surface, when viewed in a horizontal plane, is a plane curve.

13. A boot as claimed in claim 1, wherein a respective array of said studs is provided on a heel and a sole portion of the boot base.

14. A boot as claimed in claim 1, wherein the array of studs on the sole is arranged in partial or complete rings surrounding a central area of the sole.

15. A boot as claimed in claim 1, wherein all of the studs are similarly shaped.

* * * * *